US006537155B2

(12) United States Patent
Steve et al.

(10) Patent No.: US 6,537,155 B2
(45) Date of Patent: Mar. 25, 2003

(54) COUNTERWEIGHT ARBOR GUIDE SYSTEM

(75) Inventors: Walker Steve, Naples, NY (US); Michael S. Murphy, Baldwinsville, NY (US)

(73) Assignee: J. R. Clancy, Inc., Syracuse, NY (US)

( * ) Notice: Subject to any disclaimer, the term of this patent is extended or adjusted under 35 U.S.C. 154(b) by 0 days.

(21) Appl. No.: 09/921,367

(22) Filed: Aug. 2, 2001

(65) Prior Publication Data

US 2002/0082096 A1 Jun. 27, 2002

Related U.S. Application Data

(60) Provisional application No. 60/223,218, filed on Aug. 4, 2000.

(51) Int. Cl.[7] ..... A63J 1/02

(52) U.S. Cl. ..... 472/75; 472/79; 16/94 R

(58) Field of Search ..... 472/57, 75, 76, 472/77, 78, 79, 80; 16/94 R, 94 D, 95 R, 95 D, 96 D

(56) References Cited

U.S. PATENT DOCUMENTS

| | | | | | |
|---|---|---|---|---|---|
| 3,165,296 | A | * | 1/1965 | Drew | 472/78 |
| 4,166,306 | A | * | 9/1979 | Janson | 16/94 R |
| 4,775,127 | A | * | 10/1988 | Nakamura | 16/94 R |
| 4,795,405 | A | | 1/1989 | Davis | |
| 5,711,713 | A | * | 1/1998 | Krueger | 472/77 |

* cited by examiner

*Primary Examiner*—Kien T. Nguyen
(74) *Attorney, Agent, or Firm*—Brian B. Shaw, Esq.; Roger Aceto, Esq.; Harter, Secrest & Emery LLP

(57) ABSTRACT

A method for securing a counterweight guiding system in performance rigging in places of entertainment. An elongate guide rail has a cross-section which interlocks with a clip, the clip extending transversely beyond the guide. The guide rail is secured to a support by fastening the clip to the support, the guide itself not requiring any specific fastening points.

19 Claims, 5 Drawing Sheets

COUNTERWEIGHT ARBOR GUIDE SYSTEM

This application claims the benefit of Ser. No. 60/223,218, filed Aug. 4, 2000.

FIELD OF THE INVENTION

The invention relates to guiding systems, and particularly to securing a guiding system for counterweights in performance rigging in places of entertainment.

BACKGROUND

Performance rigging includes numerous items of equipment including curtains, lights, scenic elements and other performance enhancements that must be moved up and down or in and out of the performance space balanced by counterweights. Typically, counterweights are installed in frames that are, in turn, guided by long runners either singly or in pairs.

A generally vertical runner is usually connected to a generally horizontal support member by attachment means such as bolts passing through attachment holes in the runners and the support. In order that the runner can be vertically adjustable relative to the support, a plurality of attachment holes must be provided along at least a portion of the height of the runner.

Furthermore, a plurality of support members may be necessary, in which case there must be a correspondence between the separation of the support members and the spacing of the particular attachment holes.

Such an arrangement is inconvenient, since it requires relatively precise positioning of the runner. This can be overcome by providing longitudinally elongate attachment holes in the runner. However, adjustment of the rigging can be needlessly time-consuming, especially if any of the structural members is misaligned.

Since performance rigging may need to be reconfigured between performances, the guide system the capability of being easily assembled and dismantled. There is therefore a need for a guide system for which alignment is less critical.

SUMMARY OF THE INVENTION

The present invention is a system in which an arbor is guided between generally vertical pairs of rails or guides attached to generally horizontal supports. While the horizontal support has a plurality of attachment holes spaced to define a consistent spacing between the members of a given pair of guides, the guides themselves do not have distinct attachment points; instead, each guide engages a clamp or clip which is in turn attached to the support. Therefore, the guide is not confined to discrete vertical relationships with the support. The clip and the guide are configured to have precisely mating surfaces which preclude undesired movement of the guide relative to the support. Also, the clip can be attached to a backing plate instead of to the support. This allows the attachment of an additional length of guide or of various auxiliary devices to the guide, without the necessity of any attachment holes in the guide.

DETAILED DESCRIPTION OF THE INVENTION

Figure 1:
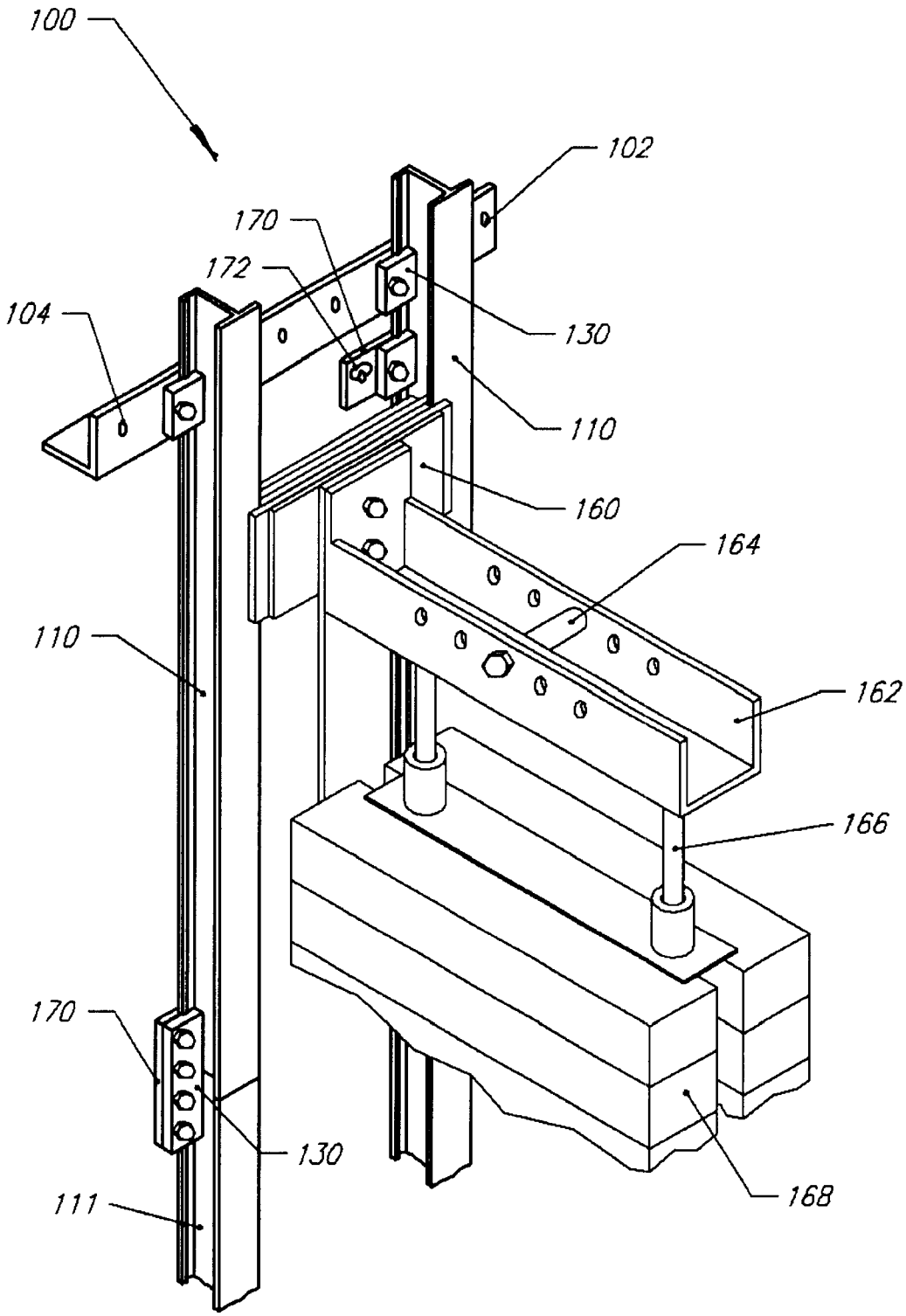
FIG. 1 is a perspective view of a counterweight arbor guide system.
Figure 7:
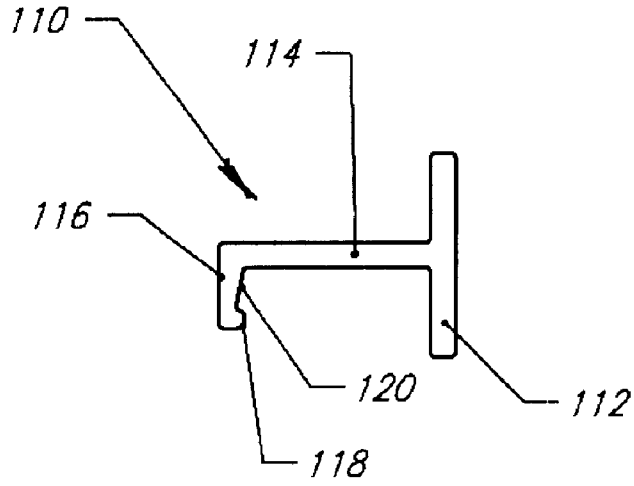
FIG. 7 is a plan view of the guide.
Figure 6:
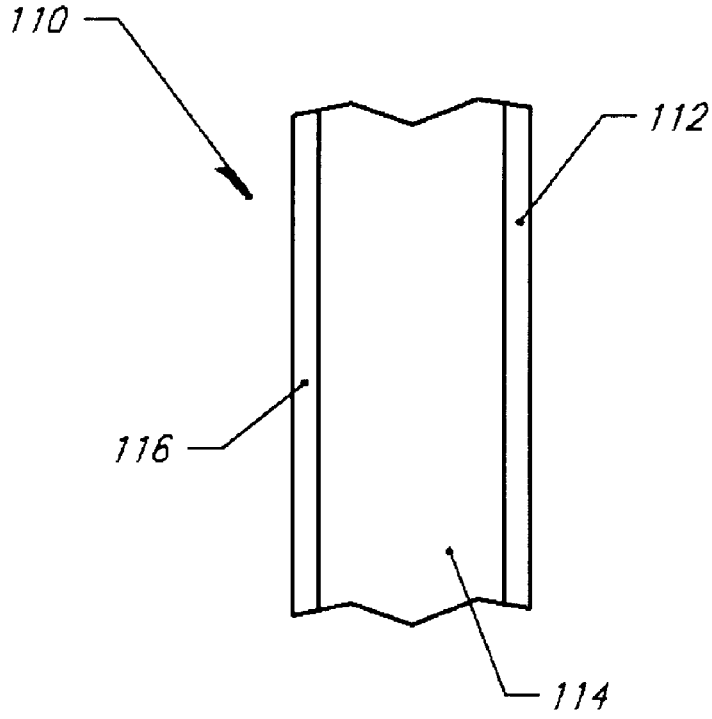
FIG. 6 is a side elevation of a portion of the guide.

Referring now to the drawings, FIG. 1 shows a guide assembly or system 100 including a generally vertical elongate guide 110 with a generally "J" shaped cross section. As best seen in FIGS. 6 and 7, the J-shaped cross section includes a guide flange 112, a strut 114 extending from the guide flange 112 and a foot 116 extending from the strut 114, the foot 116 having a stop 118 spaced from the strut 114 and a ramp 120 intersecting the stop 118. Normally, two such guides 110 are attached to a support with a predetermined spacing between them. The support is typically a generally horizontal support member 102. Although the J-shaped cross section for the guide 110 is preferred, other cross-sections may be selected.

Figure 3:
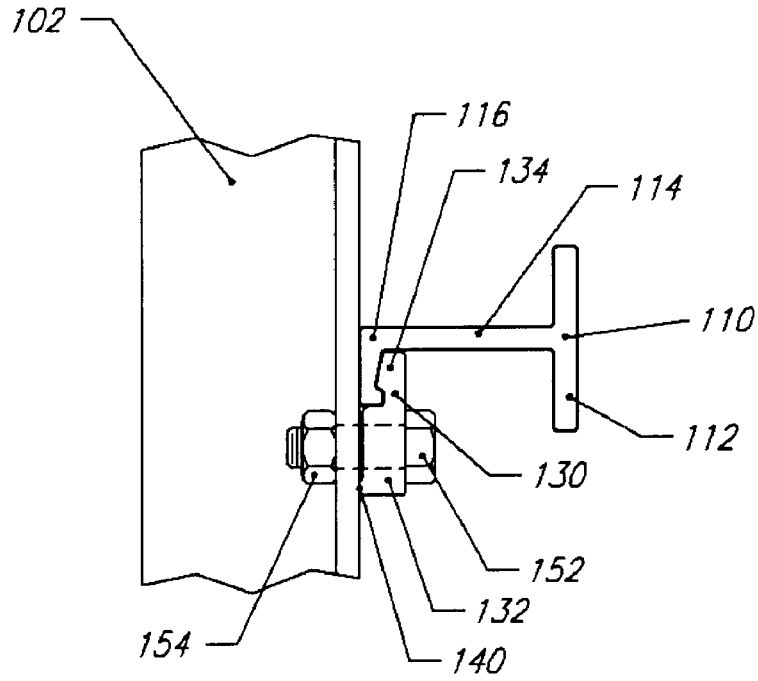
Figure 2:
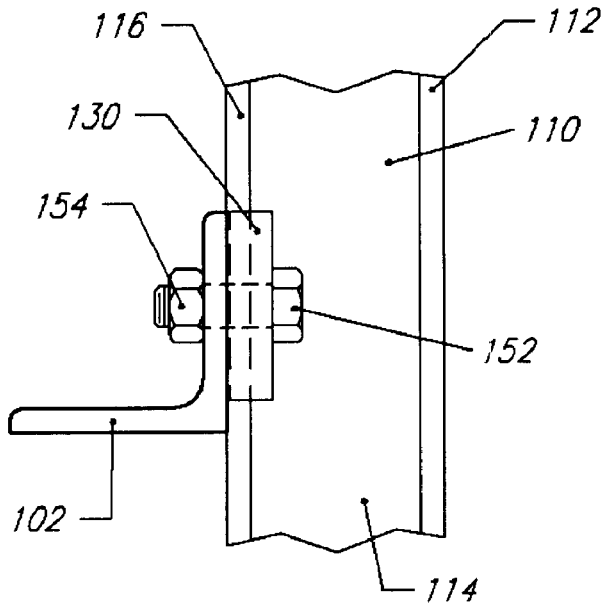
FIG. 2 is a side elevation of a portion of a guide of the assembly secured with a clip to a support FIG. 3 a plan view of the elements of FIG. 2
Figure 9:
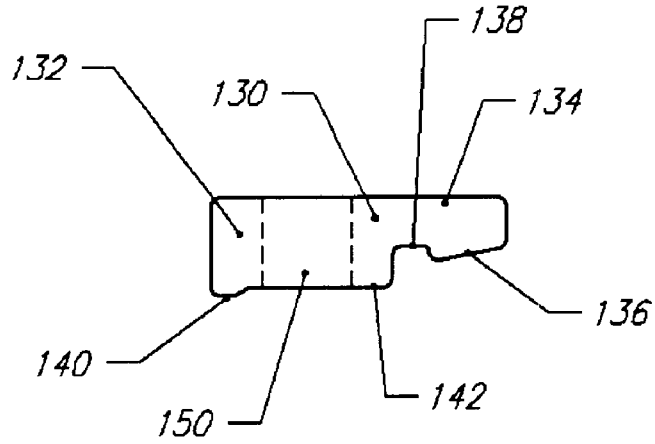
FIG. 9 is a plan view of the clip.
Figure 8:
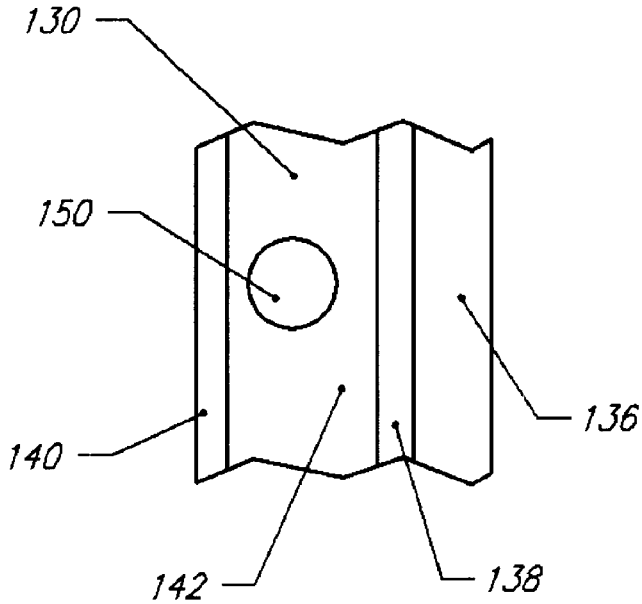
FIG. 8 is a side elevation of a portion of the clip.

The means of attachment of the guide 110 to the support member 102 includes a clip 130 having a connector portion 132 and an interlock portion 134 (FIGS. 8 and 9). The interlock portion 134 includes a ramp-contacting surface 136 and a shoulder 138. Thus, as seen in FIG. 3, the interlock portion 134 of the clip 130 and the foot 116 of the guide 110 are configured to have complementary surfaces. The support member 102 is typically permanently attached to some suitably strong feature of a building.

The connector portion 132 of the clip 130 has an attachment hole 150 for accepting a fastener such as a screw 152. The screw 152 typically has a hexagonal head for engaging a wrench, although other types of screw can be used. The support member 102 has a plurality of corresponding holes 104 that can receive the screw 152. The spacing of each receiving hole 104 from another (which may or may not be its nearest neighbor) is selected to correspond with the defined spacing between cooperating guides 110. Each receiving hole 104 is typically sized to provide clearance for the screw 152 which can then be secured with a nut 154. Alternatively, the receiving hole 104 may be tapped to threadedly accept the screw 152.

In the guide system 100 as installed, the guide 110 is in a desired position relative to the support member 102 and the clip 130 is attached to the support member 102 with the screw 152. When the screw 152 is tightened, the complementary surfaces of the clip 130 and the guide 110 engage as in FIG. 3. The ramp-contacting surface 136 abuts the ramp 120, and the shoulder 138 contacts the stop 118. Thus the guide 110 is precisely located vertically relative to the support member 102, while being precluded by the configurations of the complementary surfaces from undesired sideways movement.

The spacing of the cooperating guides 110 is such as to accept an arbor or shoe 160, which can be moved up and down therebetween. Typically, the arbor 160 is configured to slidingly engage the guide flange 112 of each cooperating guide 110. Extending from the arbor 160 as in FIG. 1 is a U-shaped rail 162 having a cross-piece 164 for attaching a cable (not shown). Bars 166 extend downwardly from the rail 162 for supporting selected counterweights 168.

Figure 5:
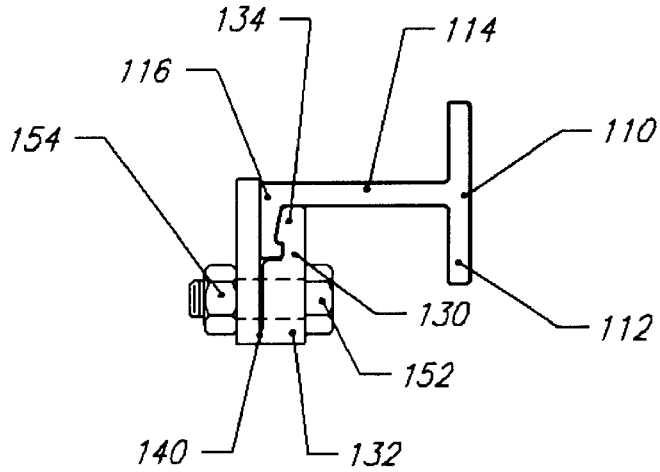
FIG. 5 is a plan view of the elements of FIG. 4.
Figure 4:
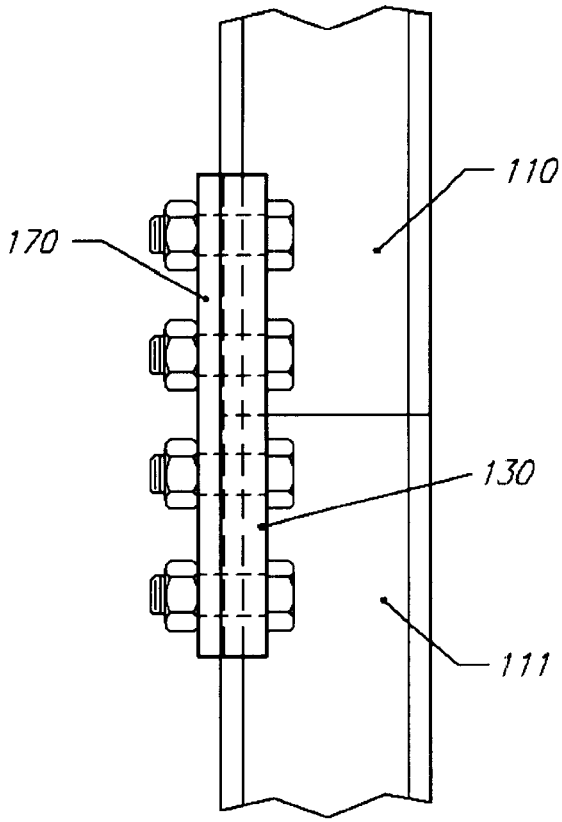
FIG. 4 is a side elevation of portions of two colinear guides spliced together using the clip and a backing plate.

In another embodiment of the invention, shown in FIGS. 1, 4 and 5, a second guide 111 is spliced to the first guide 110 in order to extend the vertical height of the assembly 100. In this embodiment, the clip 130 has a plurality of attachment holes 150 in the connector portion 132. Instead of being attached to the support member 102, it is secured to a backing plate 170. The clip 130 and the backing plate 170 are tightened against both the first and second guides 110 and 111. The backing plate 170 need merely be a flat piece of material with appropriately located holes. This provides a secure connection between the first and second guides 110 and 111, thus obviating any need to provide fastening holes in the guides.

In yet another embodiment of the invention, the guide 110 may be employed as a mount for an accessory such as a limit switch, sensor or end stop. In this case, the clip 130 and backing plate 170 would be secured against the guide 110, the backing plate 170 being either attached to or an integral part of the structure of the accessory 172.

Note that one extremity of the clip 130 has a lip 140 protruding slightly beyond a support-facing surface 142 of the connector portion 132, the support-facing surface being defined as that surface intended to face the support member 102 or backing plate 170. The lip 140 is effectively a fulcrum to provide leverage in securing together the clip 130, the guide 110 and the support member 102 or backing plate 170. If the lip 140 were absent, the security of the attachment of the various components would be critically dependent on their relative dimensions, and could be compromised by small dimensional variations. The clip 130 is sized relative to the guide 110 so that when it retains the guide 110 against the support member 102, the support-facing surface 142 is precluded from significant contact with the support member 102; the retaining force between the clip 130 and the support member 102 is concentrated at the lip 140. Similar considerations apply to the relationship between the clip 130 and the backing plate 170.

Note also that there would typically be a plurality of support members 102 at different heights.

In the first embodiment, the system 100 is assembled as follows. The guide 10 is suitably positioned relative to the support member 102, and secured thereto by aligning the clip 130 with the receiving hole 104, and fastening together the clip 130, the guide 110 and the support member 102 with the screw 152 and a nut. To allow for later adjustment, the screw 152 need not be completely tightened at this stage. The cooperating guide 110 is similarly fastened to the support member 102 at another appropriate receiving hole 104. The operation is repeated at any other support member 102 as needed, each screw 152 ultimately being completely tightened before installation of the arbor 160. The arbor 160 is then hoisted with the cable to a position of alignment with the guides 110, wherefrom it is lowered so that it slidingly engages the guide flanges 112 of the cooperating guides 110. The required performance rigging and the appropriate mass of counterweights are then installed, as known in the art.

The system 100 is versatile and lends itself to simple assembly and dismantling. In particular, since there is no need for fastening holes in the guide 110, it can be clamped anywhere along its height and its vertical position is continuously variable. An assembler is therefore freed from having to be concerned with vertically aligning the guide 110.

The system 100 has been shown and described in connection with various embodiments. Whereas preferred forms of the invention have been shown and described, it will realized that modifications may be made thereto without departing from the scope of the following claims.

What is claimed:

1. A guide assembly for guiding a shoe, comprising:

(a) an elongate guide for guiding the shoe, the guide having a cross section including a guide flange for contacting the shoe, a strut extending from the guide flange and a foot extending from strut, the foot having a stop spaced from the strut and a ramp intersecting the stop; and (b) a clip having a connector portion and an interlock portion, the interlock portion including a ramp-contacting surface and a shoulder, the shoulder selected to contact the stop.

2. The guide assembly of claim 1, wherein the strut is perpendicular to the guide flange.

3. The guide assembly of claim 1, wherein the foot is perpendicular to the strut.

4. The guide assembly of claim 1, wherein the connector portion of the clip includes an aperture.

5. The guide assembly of claim 1, further comprising a backing plate selected to engage the clip and retain a portion of the foot therebetween.

6. The guide assembly of claim 5, wherein the clip and the backing plate have a sufficient dimension along a length of the guide to splice together a first guide and a second guide.

7. The guide assembly of claim 1, wherein the ramp-contacting surface is selected to engage the shoulder with the stop.

8. The guide assembly of claim 1, wherein the connector portion has a support-facing surface and a lip.

9. The guide assembly of claim 8, wherein the lip protrudes from the support-facing surface.

10. The guide assembly of claim 8, wherein the lip defines a contact surface for the support-facing surface.

11. The guide assembly of claim 1, the guide cross section as defined by the guide flange, strut extending from the guide flange and foot extending form the strut being generally J-shaped.

12. A guide for a guide assembly, comprising:

an elongate bar having a cross section with a guide flange, a strut extending from the guide flange and a foot extending outward from the strut, with an outward extending end of the foot including a stop on a surface of the foot facing towards the flange and a ramp extending from the strut to the stop.

13. The guide of claim 12, the bar having a J-shaped cross section defined by the guide flange, strut extending from the guide flange and foot extending form the strut.

14. A guide assembly, comprising:

(a) an elongated guide having a cross section including a foot provided with a ramp portion and a stop; and (b) a clip having an interlock portion including complementary surfaces for engaging the ramp portion and stop of the foot, and a connector portion;

the foot and the interlock portion being configured so that when in operable engagement with the guide, the clip can be oriented only in a transverse direction while being able to clamp the guide at any longitudinal position along the guide; the connector portion extending beyond the guide.

15. The guide assembly of claim 14, the connector portion having a means of attachment to a support.

16. The guide assembly of claim 14, wherein the connector portion has a support-facing surface and a lip extending outward from the support-facing surface.

17. The guide assembly of claim 16, wherein the lip protrudes from the support-facing surface.

18. The guide assembly of claim 16, wherein the lip defines a contact surface for the support-facing surface.

19. The guide assembly of claim 14, the elongated guide having a J-shaped cross-section defined by a flange portion, a strut extending from the flange and the foot which extends from the strut.

* * * * *

UNITED STATES PATENT AND TRADEMARK OFFICE

CERTIFICATE OF CORRECTION

PATENT NO. : 6,537,155 B2 
DATED : March 25, 2003
INVENTOR(S) : Steve Walker and Michael S. Murphy It is certified that error appears in the above-identified patent and that said Letters Patent is hereby corrected as shown below:

Title page,
Item [75], Inventor's name reading "Walker Steve" should read -- Steve Walker --.

Column 3,
Line 36, "10" should read -- 110 --.

Signed and Sealed this

Ninth Day of September, 2003

JAMES E. ROGAN
*Director of the United States Patent and Trademark Office*